US005956009A

United States Patent [19]

Zhang et al.

[11] Patent Number: 5,956,009

[45] Date of Patent: Sep. 21, 1999

[54] ELECTRO-OPTICAL DEVICE

[75] Inventors: Hongyong Zhang; Kenji Otsuka; Satoshi Teramoto, all of Kanagawa, Japan

[73] Assignee: Semiconductor Energy Laboratory Co., Kanagawa-Ken, Japan

[21] Appl. No.: 08/866,811

[22] Filed: May 30, 1997

[30] Foreign Application Priority Data

May 31, 1996 [JP] Japan ..... 8-160513

[51] Int. Cl.[6] ..... G09G 3/36

[52] U.S. Cl. ..... 345/93; 345/98

[58] Field of Search ..... 345/93, 98, 100, 345/99, 87, 204–206

[56] References Cited

U.S. PATENT DOCUMENTS 5,555,001 9/1996 Lee et al. ..... 345/93

5,616,936 4/1997 Misawa et al. ..... 345/99

5,781,171 7/1998 Kihara et al. ..... 345/93

*Primary Examiner*—Regina Liang

*Attorney, Agent, or Firm*—Fish & Richardson P.C.

[57] ABSTRACT

There is disclosed an active matrix liquid crystal display that suppresses formation of a stripe pattern on the displayed image. An active matrix circuit, a peripheral drive circuit, and A image data signal lines for supplying image data signals are all integrated on a common substrate. The liquid crystal display includes a sampling circuit to which sampling circuit input lines are connected. These sampling circuit input lines are in contact with the image data signal lines and include dummy conducting lines extending to a buffer circuit. These dummy lines average out impedances of the individual image data signal lines, thus making uniform the amounts of image data signals lost from the image data signal lines. Thus, the formation of the stripe pattern is suppressed.

19 Claims, 7 Drawing Sheets

TO ACTIVE MATRIX CIRCUIT 25

TO ACTIVE MATRIX CIRCUIT 25

TO ACTIVE MATRIX CIRCUIT 15

ELECTRO-OPTICAL DEVICE

BACKGROUND OF THE INVENTION

1. Field of the Invention

The present invention relates to improvements in the configuration of an active matrix display and, more particularly, to improvements in the configuration of a peripheral drive circuit for driving active matrix regions.

2. Description of the Related Art

An active matrix liquid crystal display comprising a substrate on which a peripheral drive circuit is integrated with other circuits is known. This common substrate is made of glass or quartz. Some TFTs are arranged in the active matrix circuit, while other TFTs are arranged in the peripheral drive circuit. This configuration is obtained by fabricating these two kinds of TFTs by the same process steps. A TFT is generally made of a thin film that has crystallinity and is represented as P—Si.

Peripheral drive circuits are classified into scanning drive circuit (gate drive circuit) and signal drive circuit (source drive circuit) in terms of function. Drive signals from the scanning drive circuit are supplied to the gate electrodes of TFTs or pixel transistors arranged in rows and columns within the active matrix circuit. Drive signals from the signal drive circuit (source drive circuit) are fed to the source electrodes of the TFTs or pixel transistors arranged in rows and columns.

Generally, the scanning drive circuit is required to be operated at tens of kilohertz to hundreds of kilohertz, while the signal drive circuit needs to be operated at several megahertz to tens of megahertz. However, TFTs obtained at present are guaranteed to operate only up to several megahertz.

Therefore, fabricating the scanning drive circuit from TFTs presents no problems but where the signal drive circuit is constructed from TFTs, the required operation cannot be performed.

To avoid this problem, a polyphase driving method (data division method) has been used. In particular, an image data signal is divided into plural image data groups. Some of these data groups are simultaneously selected according to signals from a shift register circuit. Thus, the frequency at which the shift register circuit must operate can be scaled down. If the image data signal is divided by four, the operating frequency of the shift register circuit can be scaled down by a factor of 4. This polyphase driving method is described in *Flat Panel Display*, p. 182, Nikkei BP Corporation, Japan, 1994.

One example of the scanning drive circuit that divides a data signal into 8 groups is shown in FIG. 3, where a signal supplied from a shift register circuit 10 via a buffer circuit 11 causes a sampling circuit 13 to select some of image data signals supplied to the bus signal lines 12. The selected signals are sent to an active matrix circuit 15 via image signal lines 14. The bus signal lines 12 are 8 separate lines. In this configuration, 8 analog switch circuits are operated simultaneously in response to the output signal from one shift register circuit. Image signals are selected simultaneously from their respective bus signal lines corresponding to the 8 image signal lines (source lines).

A conductor pattern forming the bus signal lines shown in FIG. 3 is depicted in FIG. 4. Conducting lines D1'–D8' are in contact with the bus signal lines and run to analog switches of the sampling circuit 102. Conducting lines a1–a8 run from the buffer circuit 101 to the analog switches of the sampling circuit 102.

It is observed that the image presented on the active matrix liquid crystal display of the structure shown in FIGS. 3 and 4 has a periodic stripe pattern. Careful observation of this stripe pattern reveals that it corresponds to the repetition of the conducting lines D1'–D8' shown in FIG. 4. For example, the corresponding portions of the conducting lines D1' and D8' differ greatly in resistance and parasitic capacitance. The resistance difference is caused by the difference in the number of overlapping portions at the intersections of the conducting lines D1–D8 and the conducting lines D1'–D8'.

More specifically, the conducting lines D1–D8 intersect with the conducting lines D1'–D8' at locations, where the conducting lines of one group pass over the conducting lines of the other. Consequently, the metallization layer forming the conducting lines is thinned at these locations. Of course, this increases the resistance. Furthermore, at these intersections, capacitances are created between the intersecting conducting lines. Accordingly, the difference in the number of overlapping portions produces different total conductor resistances and different total parasitic capacitances, as shown in FIG. 5. It is to be noted that in FIG. 5, conducting lines from the buffer circuit are not taken into account.

In this situation, the signal traveling over the signal line D1 differs in mode of propagation from the signal traveling over the signal line D8. That is, the signal traveling over the signal line D8 has a larger signal component dissipating via parasitic capacitance than that of the signal traveling over the signal line D1. Therefore, the signal traveling over the signal line D8 is smaller in magnitude than the signal traveling over the signal line D1 provided that the same signal is supplied to both conducting lines. This tendency becomes more conspicuous with going from D1 toward D8, because more signal is lost due to conductor resistance and parasitic capacitance with going from D1 to D2, from D2 to D3, and so forth. As a result, different amounts of information are written to different pixels at the same time. In other words, different amounts of electric charge are stored on different pixels, giving rise to the aforementioned stripe pattern.

SUMMARY OF THE INVENTION

It is an object of the present invention to provide a technique for removing the stripe pattern produced by the above-described factors.

One display device in accordance with the present invention comprises a substrate on which an active matrix circuit, a peripheral drive circuit, and A (A is a natural number equal to or greater than 2) conducting lines are arranged. These conducting lines (hereinafter referred to as the image data signal lines) supply image data signals. Image signal lines and scanning signal lines are arranged in the active matrix circuit. The peripheral drive circuit has multiple stages of shift register circuits and a sampling circuit for selecting some of the image data signals according to signals from the shift register circuits. In the sampling circuit, image data signals to be supplied from the A image data lines to the A image signal lines are simultaneously selected in response to the output signal from one stage of shift register circuit. Of the A image data signal lines, (A−1) lines meet dummy conducting lines.

In the above-described structure, one example of the above-described dummy conducting lines is a conductor pattern extending to a buffer circuit 201 from the conducting lines D2'–D8', which in turn run to a sampling circuit 202 as shown in FIG. 1. Another example of the dummy lines consists of conducting lines that are connected with a common conducting line C placed at an appropriate potential but are disconnected from the conducting lines D2'–D8', as shown in FIG. 7. In either case, A=8, and the (A–1) conducting lines D1–D7 intersect with the dummy lines.

A specific example of the configuration of another display device in accordance with the invention is shown in FIG. 2. In this example, A=8. This display device comprises a substrate on which an active matrix circuit 25, a peripheral drive circuit, and A (A is a natural number equal to or greater than 2; in this case A=8) conducting lines or bus lines 22 are arranged. These conducting lines (hereinafter referred to also as the image data signal lines) supply image data signals. Image signal lines 24 and scanning signal lines are arranged in the active matrix circuit 25. The peripheral drive circuit has multiple stages of shift register circuits 20 and a sampling circuit 23 for selecting some image data signals according to signals from the shift register circuits 20. In the sampling circuit 23, image data signals to be supplied from the A image data signal lines 22 to the A image signal lines are simultaneously selected in response to the output signal from one stage of shift register circuit. All of those conducting lines that are in contact with the A image data signal lines 22 and extend to the sampling circuit 23 overlap the A image data signal lines 22 at A locations.

In this structure, all the bus lines 22 intersect at the same number of locations as the conducting lines running to the sampling circuit 23. Therefore, the resistance and capacitance created at each intersection can be made uniform for every bus line. Consequently, it is possible to compensate for variations in loss of signal traveling over the bus lines 22.

A further display device in accordance with the present invention comprises a substrate on which an active matrix circuit, a peripheral drive circuit, and A (A is a natural number equal to or greater than 2) conducting lines are arranged. These conducting lines (hereinafter referred to as the image data signal lines) supply image data signals. Image signal lines and scanning signal lines are arranged in the active matrix circuit. The peripheral drive circuit has multiple stages of shift register circuits and a sampling circuit for selecting some of the image data signals according to signals from the shift register circuits. In the sampling circuit, image data signals to be supplied from the A image data signal lines to the A image signal lines are simultaneously selected in response to the output signal from one stage of shift register circuit. All of those conducting lines that are in contact with the A image data signal lines and extend to the sampling circuit overlap at the same number of locations as the A image data signal lines.

A still other display device in accordance with the present invention comprises a substrate on which an active matrix circuit, a peripheral drive circuit, and A (A is a natural number equal to or greater than 2) conducting lines are arranged. These conducting lines (hereinafter referred to as the image data signal lines) supply image data signals. Image signal lines and scanning signal lines are arranged in the active matrix circuit. The peripheral drive circuit has multiple stages of shift register circuits and a sampling circuit for selecting some of the image data signals according to signals from the shift register circuits. In the sampling circuit, image data signals to be supplied from the A image data signal lines to the A image signal lines are simultaneously selected in response to the output signal from one stage of shift register circuit. A sampling circuit input lines extend to the sampling circuit and are in contact with the A image data signal lines. Of these A sampling circuit input lines, (A–1) lines have a dummy pattern extending away from the sampling circuit.

The conducting lines D1'–D8' shown in FIG. 1 provide an example of the above-described dummy pattern. The provision of this dummy pattern averages out conductor resistances and parasitic capacitances of the conducting lines D1–D8 that supply A (in the case of FIG. 1, A=8) image data items.

Other objects and features of the invention will appear in the course of the description thereof, which follows.

DETAILED DESCRIPTION OF THE PREFERRED EMBODIMENTS

Figure 1:
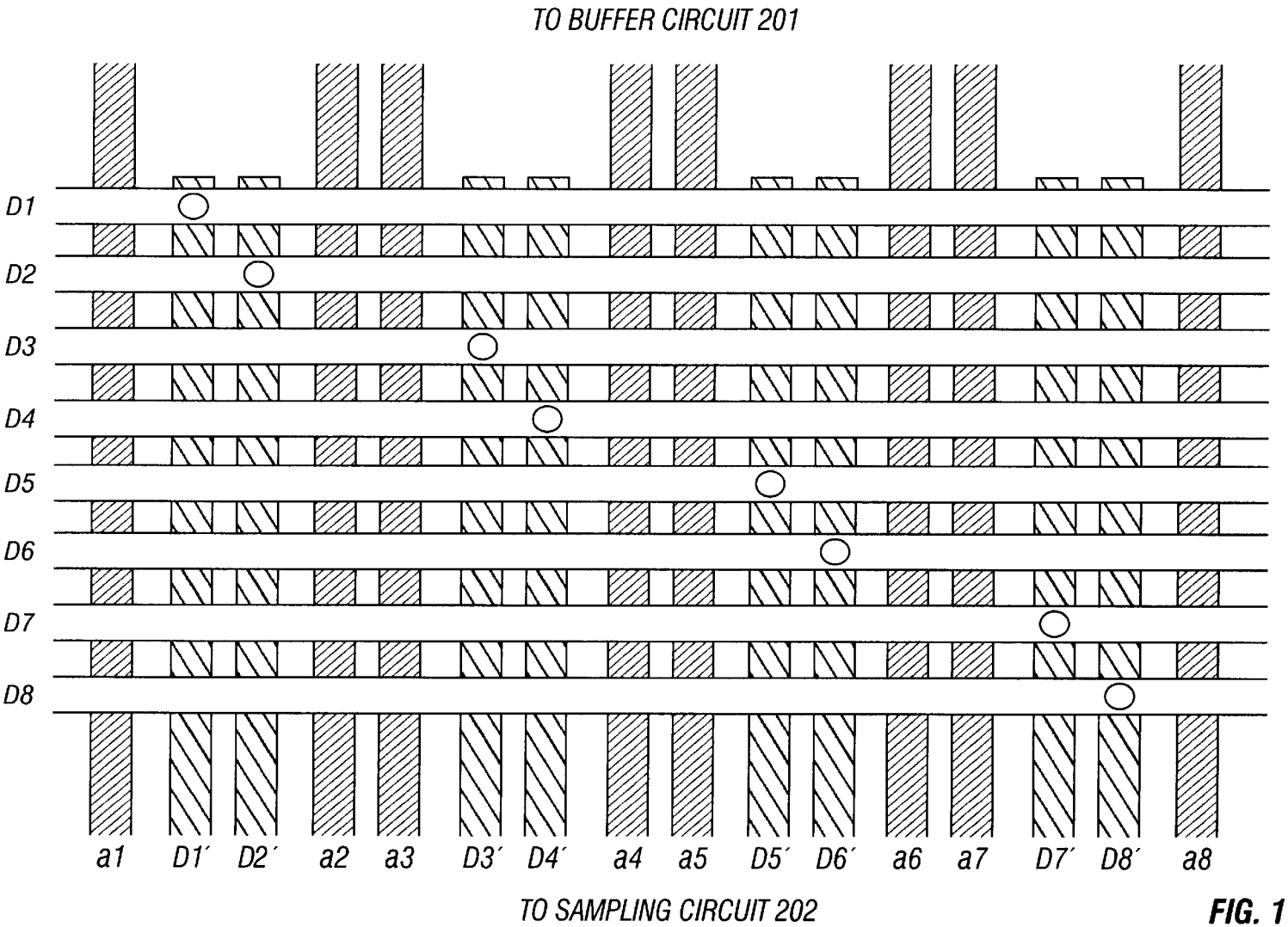
FIG. 1 is a diagram illustrating a conductor pattern where image data signal lines (D1–D8) intersect with conducting lines (D1'–D8') included in a sampling circuit, the pattern being used in a display device in accordance with the present invention.

A typical configuration of the present invention is shown in FIG. 1, where conducting lines D1–D8 supply image data signals. Conducting lines D1'–D8' running to a sampling circuit intersect with all the conducting lines D1–D8 at the same number of locations. Dummy conducting lines that are not required in essence are made to extend to a buffer circuit to average out parasitic capacitances and resistances of the signal lines D1–D8, thus compensating for variations in amounts of signals lost from image data signals traveling over the conducting lines D1–D8. In consequence, any stripe pattern appearing on the viewing screen can be suppressed.

Embodiment 1

Figure 2:
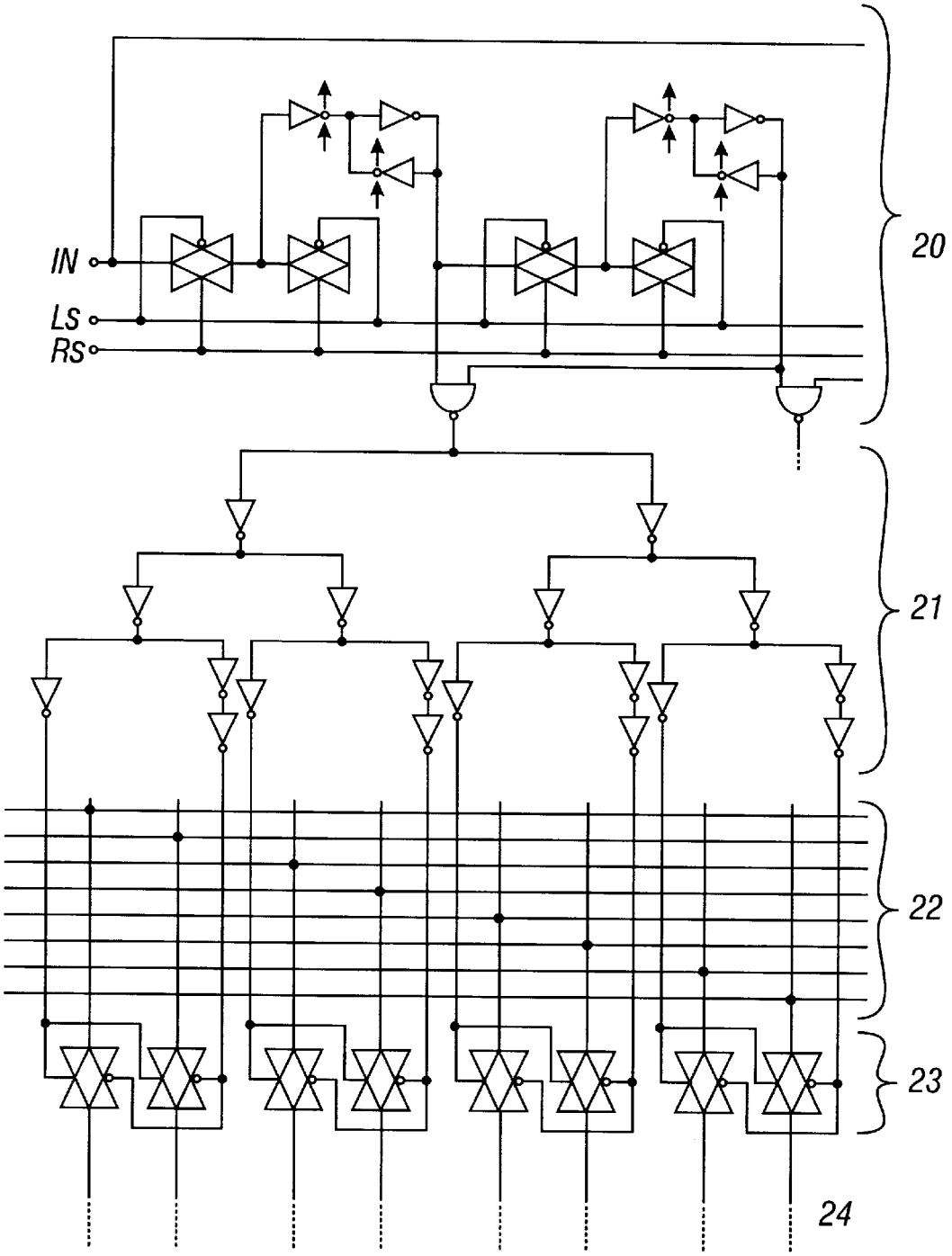
FIG. 2 is a circuit diagram of a signal drive circuit, or a source drive circuit, used in a display device in accordance with the invention.

An active matrix liquid crystal display in accordance with the present invention has a peripheral drive circuit therein. This liquid crystal display has a scanning drive circuit whose construction is shown in FIG. 2, where signals are supplied from a shift register circuit 20 to a sampling circuit 23 via a buffer circuit 21 to activate analog switches included in the sampling circuit 23. Image data signals are supplied from bus lines 22 to their respective image signal lines 24.

In the present embodiment, the bus lines 22 intersect with conducting lines running to the sampling circuit 23 at intersections that are formed in a pattern as shown in FIG. 1. That is, dummy interconnects or lines extend to the shift register circuit 20. Because of this structure, all the bus lines are made uniform in resistance and capacitance. Also, losses of image data signals traveling over the bus lines can be averaged out. Consequently, any stripe pattern formed on the viewing screen can be suppressed.

Embodiment 2

The present invention can be applied to an active matrix liquid crystal display having a peripheral drive circuit therein. The invention can also be applied to an active matrix electroluminescent display. These display devices are collectively called flat panel displays.

Figure 6A:
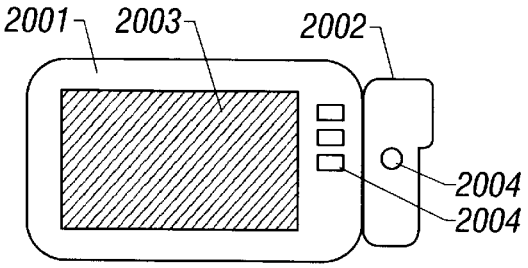
FIGS. 6(A)–6(D) show various applications of a display device in accordance with the invention.

These display devices can find use in the manner described below. Shown in FIG. 6(A) is an instrument known as a digital still camera, electronic camera, or video movie capable of treating moving pictures. This instrument has a camera portion 2002 in which a CCD camera or other appropriate image pickup means is disposed. An image picked up by the CCD camera is electronically stored in the instrument. The body of this instrument, indicated by 2001, is equipped with a display device 2003. The image picked up is displayed on the display device 2003. The instrument can be operated by manually operating control buttons 2004.

Figure 6B:
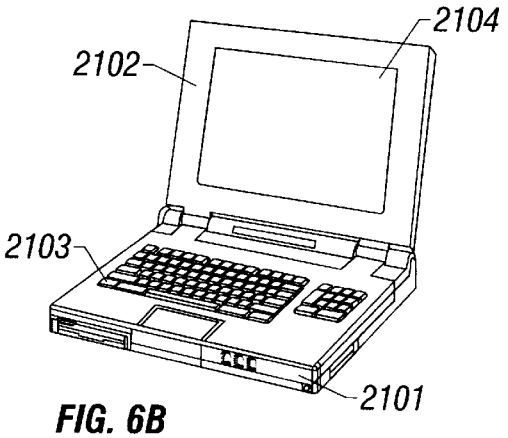

Referring to FIG. 6(B), there is shown a portable personal computer whose body is indicated by numeral 2101. An openable cover 2102 is attached to the body 2101. This cover 2102 is equipped with a display device 2104. Various kinds of information can be entered and various arithmetic operations can be performed, using a keyboard 2103.

Figure 6C:
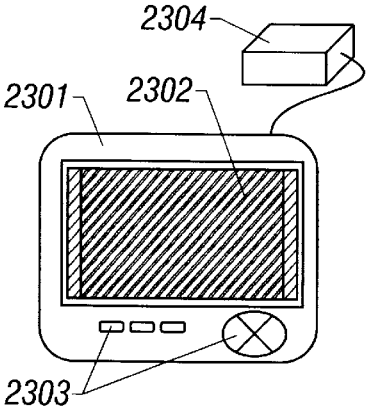

Referring to FIG. 6(C), there is shown a car navigational system using a flat panel display. The body of this navigational system is indicated by 2301 and equipped with an antenna 2304 and a display device 2302. Various kinds of information necessary for navigation are switched by operating control buttons 2303. Generally, the navigational system is operated from a remote controller (not shown).

Figure 6D:
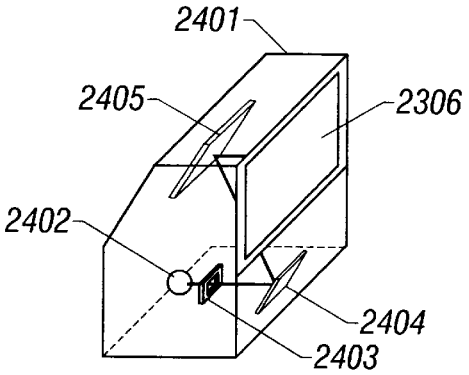

Referring next to FIG. 6(D), there is shown a projection liquid crystal display whose body is indicated by numeral 2401. Light emitted from a light source 2402 is optically modulated by a liquid crystal display 2403, producing an image. This image is then reflected by mirrors 2404 and 2405 onto a screen 2406, producing a visible image.

Embodiment 3

Figure 7:
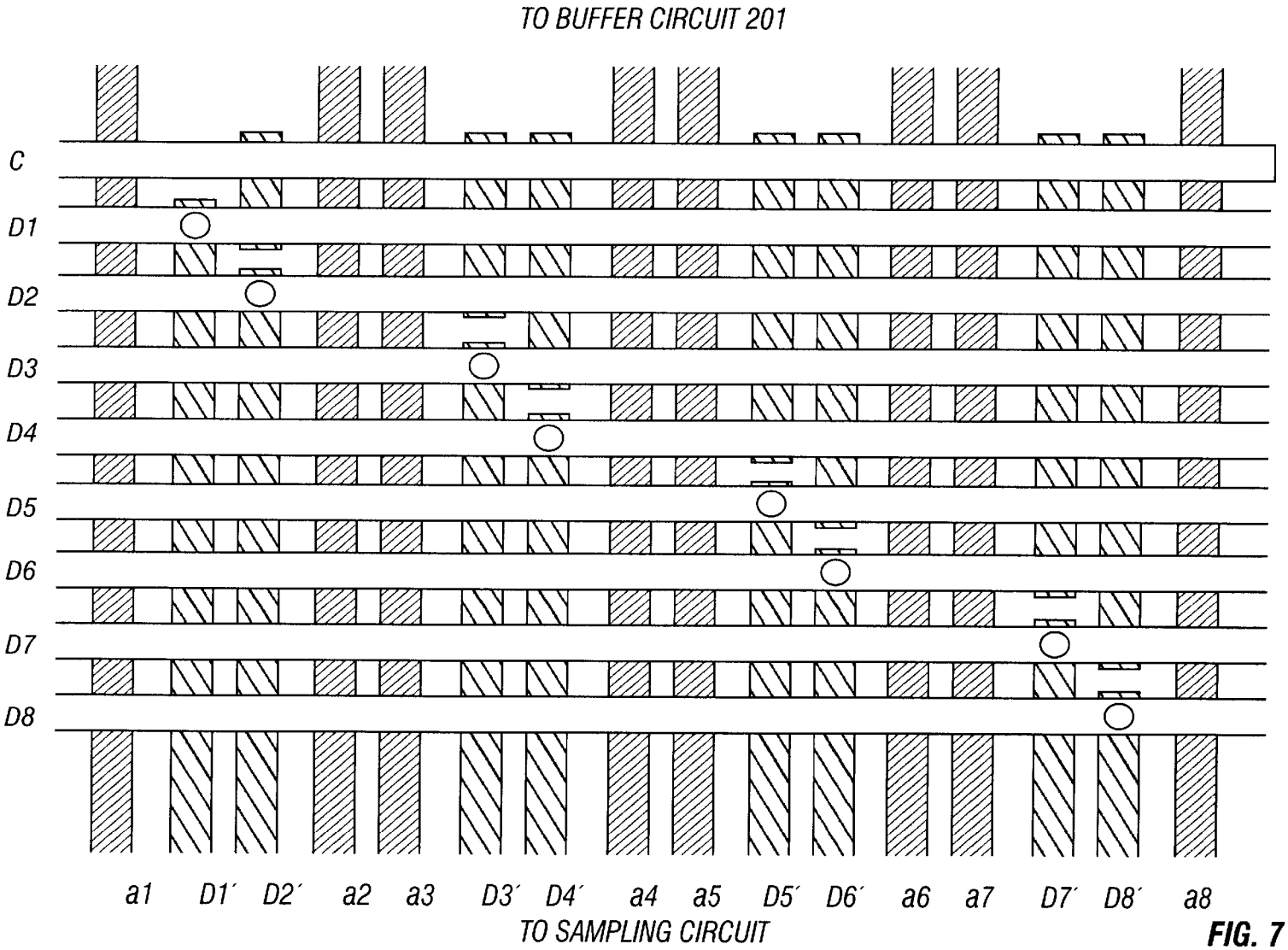
FIG. 7 is a diagram illustrating a conductor pattern used in a display device in accordance with the invention.
Figure 3:
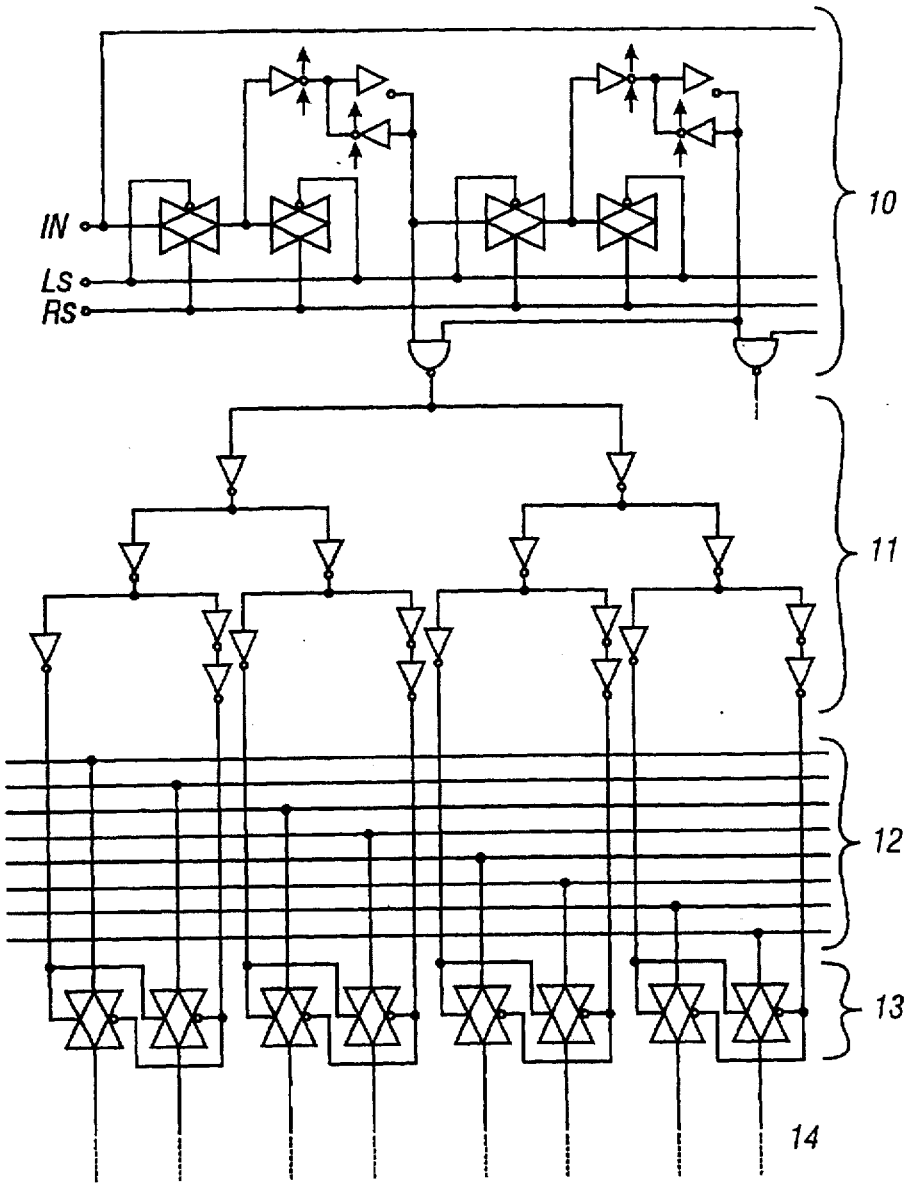
FIG. 3 (Prior Art)
Figure 5:
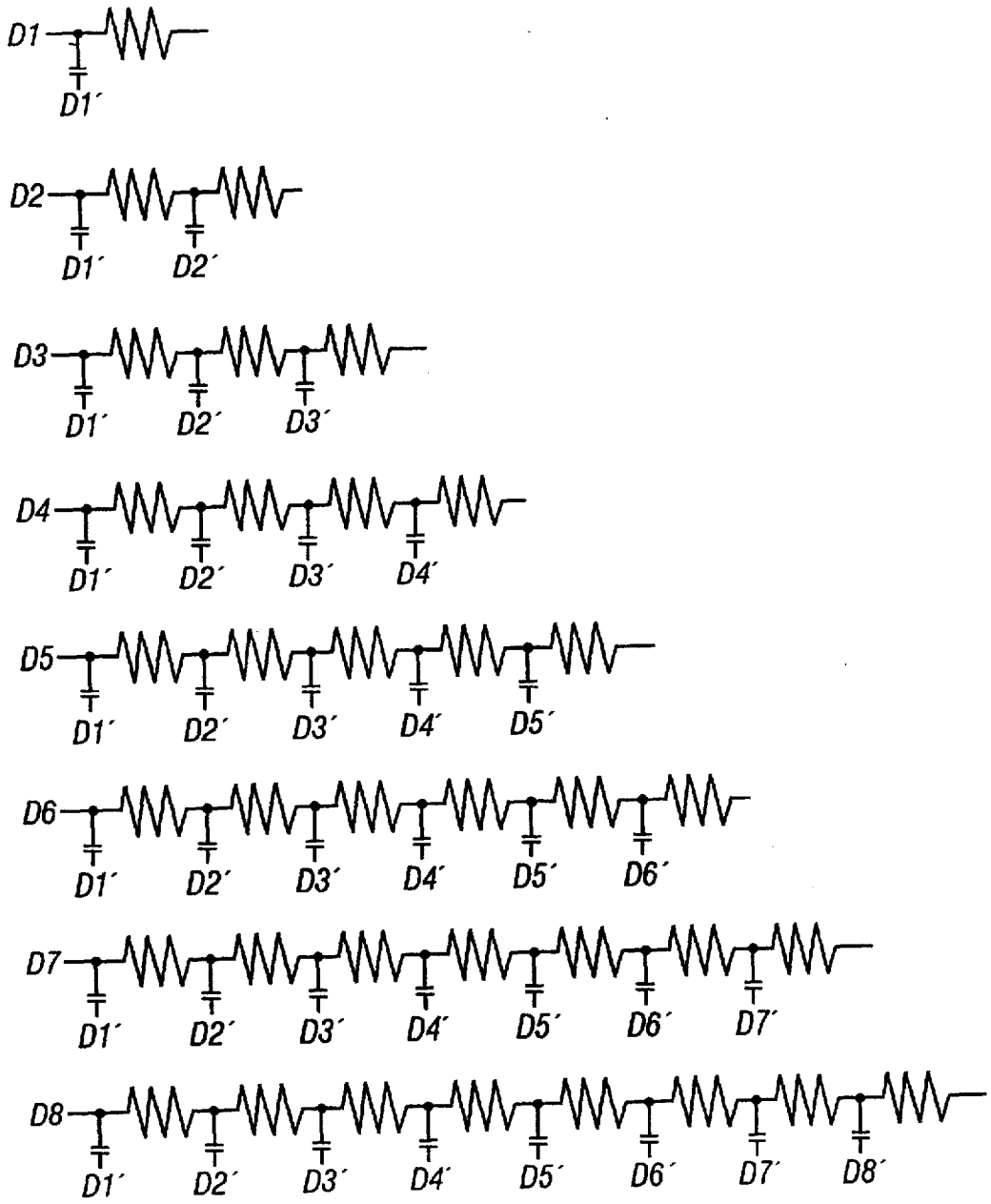
FIG. 5 (Prior Art)
Figure 7:
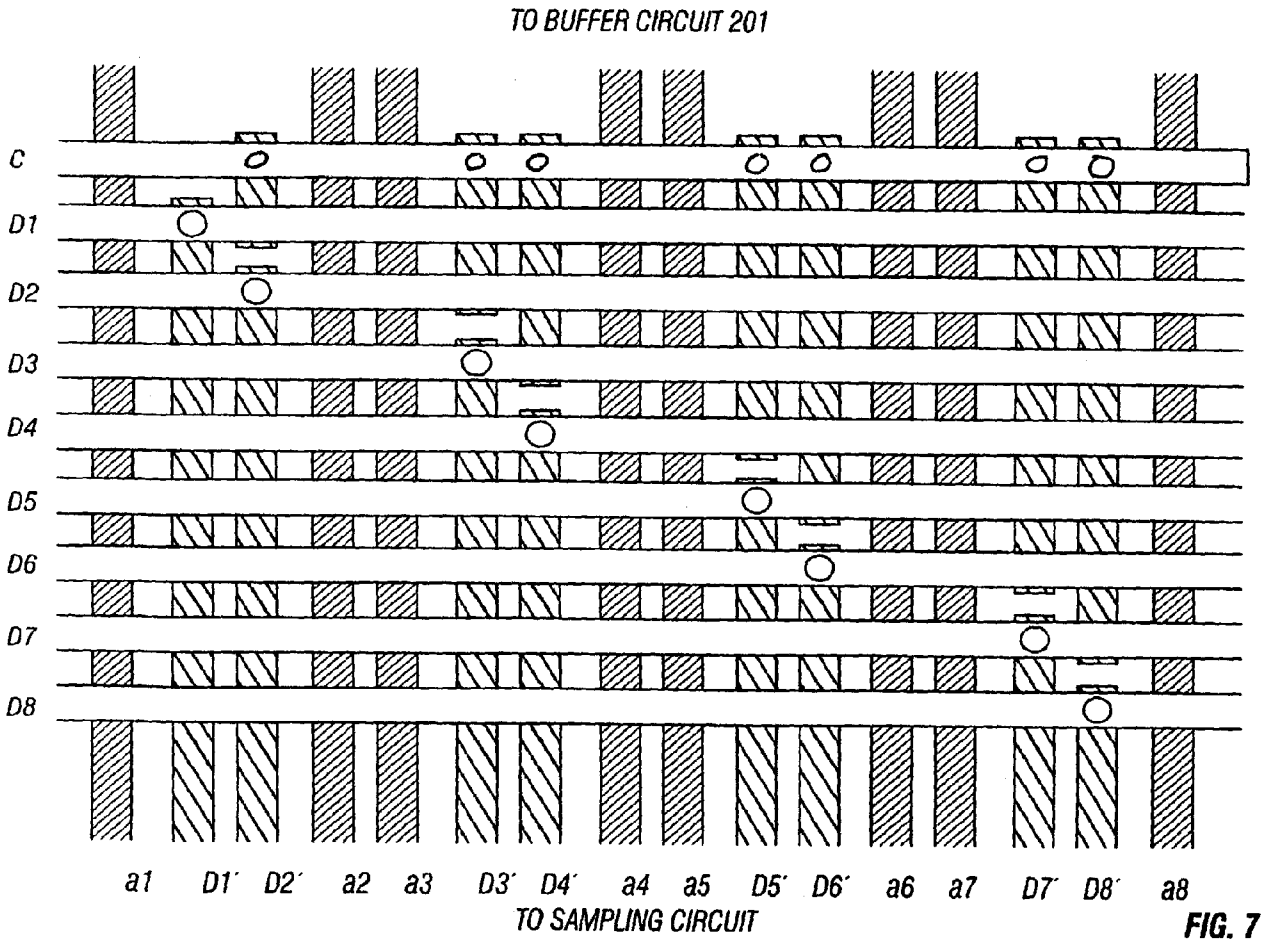

Referring to FIG. 7, there is shown a conductor pattern used in a display device in accordance with the invention. In the present embodiment, dummy lines are connected with a conducting line C at a common potential but are disconnected from conducting lines D2'–D8'. These dummy lines intersect with conducting lines D1–D7 and provide the same resistance and capacitance for conducting lines D1–D8.

The present invention can make uniform the impedances of plural conducting lines that supply image data signals. Also, losses of image signals supplied to the active matrix region can be rendered uniform, thus suppressing the stripe pattern appearing on the viewing screen.

Furthermore, an active matrix liquid crystal display having excellent display characteristics can be obtained. In the present specification, a liquid crystal display has been taken as an example. The invention is also applicable to active matrix electroluminescent displays and other flat panel displays.

What is claimed is:

1. An electro-optical device comprising:

a substrate on which an active matrix circuit, a peripheral drive circuit, and A (A is a natural number equal to or greater than 2) image data signal lines are arranged, said A image data signal lines supplying image data signals;

image signal lines and scanning signal lines arranged in said active matrix circuit;

multiple stages of shift register circuits disposed in said peripheral drive circuit;

a sampling circuit disposed in said peripheral drive circuit and acting to select some of the image data signals according to signals from said shift register circuits;

said sampling circuit being designed to simultaneously select image data signals to be supplied from said A image data signal lines to A image signal lines in response to a signal from one stage of shift register circuit; and A conducting lines extending to said sampling circuit and in contact with said A image data signal lines, said A conducting lines including (A−1) lines having a dummy pattern extending away from said sampling circuit.

2. A device according to claim 1 further comprising image sensing means for constituting a camera where an image obtained by said image sensing means is visualized on said electro-optical device.

3. A device according to claim 1 wherein said device is a projector.

4. The electro-optical device of claim 1, wherein said electro-optical device for use in one of a digital still camera, an electronic camera, a video movie, a car navigational system, a personal computer and a projection liquid crystal display.

5. An electro-optical device comprising:

a substrate on which an active matrix circuit, a peripheral drive circuit, and A (A is a natural number equal to or greater than 2) image data signal lines are arranged, said A image data signal lines supplying image data signals;

image signal lines and scanning signal lines arranged in said active matrix circuit;

multiple stages of shift register circuits disposed in said peripheral drive circuit;

a sampling circuit disposed in said peripheral drive circuit and acting to select some of the image data signals in response to signals from said shift register circuits;

said sampling circuit being designed to simultaneously select image data signals to be supplied from said A image data signal lines to A image signal lines in response to a signal from one stage of shift register circuit; and conducting lines in contact with said A image data signal lines and extending to said sampling circuit, all of said conducting lines overlapping said A image data signal lines at A locations.

6. A device according to claim 5 further comprising image sensing means for constituting a camera where an image obtained by said image sensing means is visualized on said electro-optical device.

7. A device according to claim 5 wherein said device is a projector.

8. The electro-optical device of claim 5, wherein said electro-optical device for use in one of a digital still camera, an electronic camera, a video movie, a car navigational system, a personal computer and a projection liquid crystal display.

9. An electro-optical device comprising:

a substrate on which an active matrix circuit, a peripheral drive circuit, and A (A is a natural number equal to or greater than 2) image data signal lines are arranged, said A image data signal lines supplying image data signals;

image signal lines and scanning signal lines arranged in said active matrix circuit;

multiple stages of shift register circuits disposed in said peripheral drive circuit;

a sampling circuit disposed in said peripheral drive circuit and acting to select some of the image data signals in response to signals from said shift register circuits;

said sampling circuit being designed to simultaneously select image data signals to be supplied from said A image data signal lines to A image signal lines in response to a signal from one stage of shift register circuit; and conducting lines in contact with said A image data signal lines and extending to said sampling circuit, all of said conducting lines overlapping said A image data signal lines at the same number of times.

10. A device according to claim 9 further comprising image sensing means for constituting a camera where an image obtained by said image sensing means is visualized on said electro-optical device.

11. A device according to claim 9 wherein said device is a projector.

12. The electro-optical device of claim 9, wherein said electro-optical device for use in one of a digital still camera, an electronic camera, a video movie, a car navigational system, a personal computer and a projection liquid crystal display.

13. An electro-optical device comprising:

a substrate on which an active matrix circuit, a peripheral drive circuit, and A (A is a natural number equal to or greater than 2) image data signal lines are arranged, said A image data signal lines supplying image data signals;

image signal lines and scanning signal lines arranged in said active matrix circuit;

multiple stages of shift register circuits disposed in said peripheral drive circuit;

a sampling circuit disposed in said peripheral drive circuit and acting to select some of the image data signals in response to signals from said shift register circuits;

said sampling circuit being designed to simultaneously select image data signals to be supplied from said A image data signal lines to A image signal lines in response to a signal from one stage of shift register circuit; and A sampling circuit input lines extending to said sampling circuit and in contact with said A image data signal lines, said A sampling circuit input lines including (A−1) lines having a dummy pattern extending away from said sampling circuit.

14. A device according to claim 13 further comprising image sensing means for constituting a camera where an image obtained by said image sensing means is visualized on said electro-optical device.

15. A device according to claim 13 wherein said device is a projector.

16. A device according to claim 13, wherein said dummy pattern averages out resistances and parasitic capacitances of said A image data signal lines.

17. The electro-optical device of claim 13, wherein said electro-optical device for use in one of a digital still camera, an electronic camera, a video movie, a car navigational system, a personal computer and a projection liquid crystal display.

18. An electro-optical device comprising:

a substrate on which an active matrix circuit, a peripheral drive circuit, and A (A is a natural number equal to or greater than 2) image data signal lines are arranged, said A image data signal lines supplying image data signals;

image signal lines and scanning signal lines arranged in said active matrix circuit;

multiple stages of shift register circuits disposed in said peripheral drive circuit;

an analog switch disposed in said peripheral drive circuit and acting to select some of the image data signals in response to signals from said shift register circuits;

said analog switch being designed to simultaneously select image data signals to be supplied from said A image data signal lines to A image signal lines in response to a signal from one stage of shift register circuit; and conducting lines in contact with said A image data signal lines and extending to said analog switch, all of said conducting lines overlapping said A image data signal lines at A locations.

19. An electro-optical device comprising:

a substrate on which an active matrix circuit, a peripheral drive circuit, and A (A is a natural number equal to or greater than 2) image data signal lines are arranged, said A image data signal lines supplying image data signals;

image signal lines and scanning signal lines arranged in said active matrix circuit;

multiple stages of shift register circuits disposed in said peripheral drive circuit;

an analog switch disposed in said peripheral drive circuit and acting to select some of the image data signals in response to signals from said shift register circuits;

said analog switch being designed to simultaneously select image data signals to be supplied from said A image data signal lines to A image signal lines in response to a signal from one stage of shift register circuit; and A analog switch input lines extending to said analog switch and in contact with said A image data signal lines, said A analog switch input lines including (A−1) lines having a dummy pattern extending away from said analog switch.

* * * * *

UNITED STATES PATENT AND TRADEMARK OFFICE

CERTIFICATE OF CORRECTION

Figure 3:
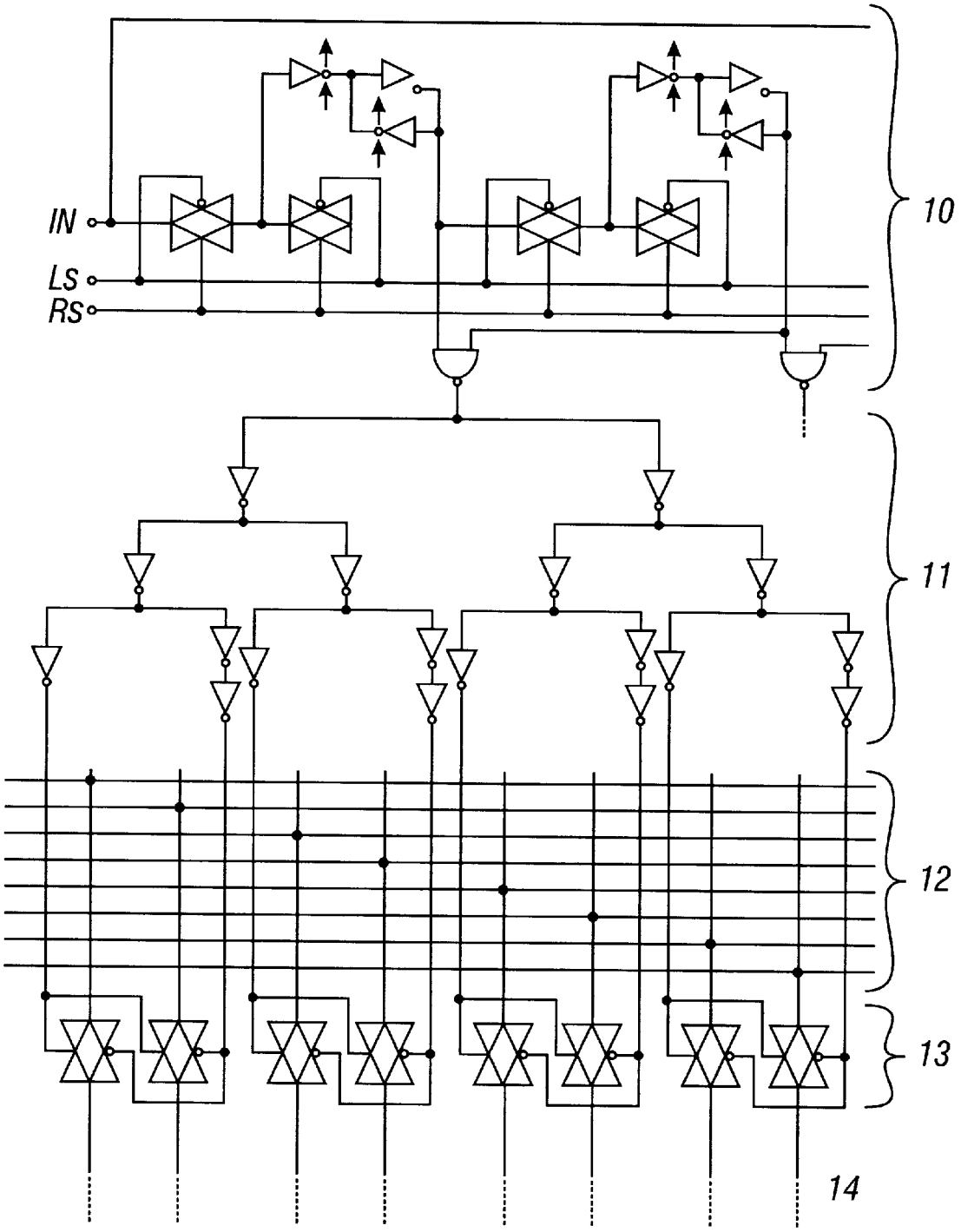
FIG. 3 (Prior Art)
FIG. 3 is a circuit diagram of a signal drive circuit, or a source drive circuit, used in a display device in accordance with the invention.
Figure 4:
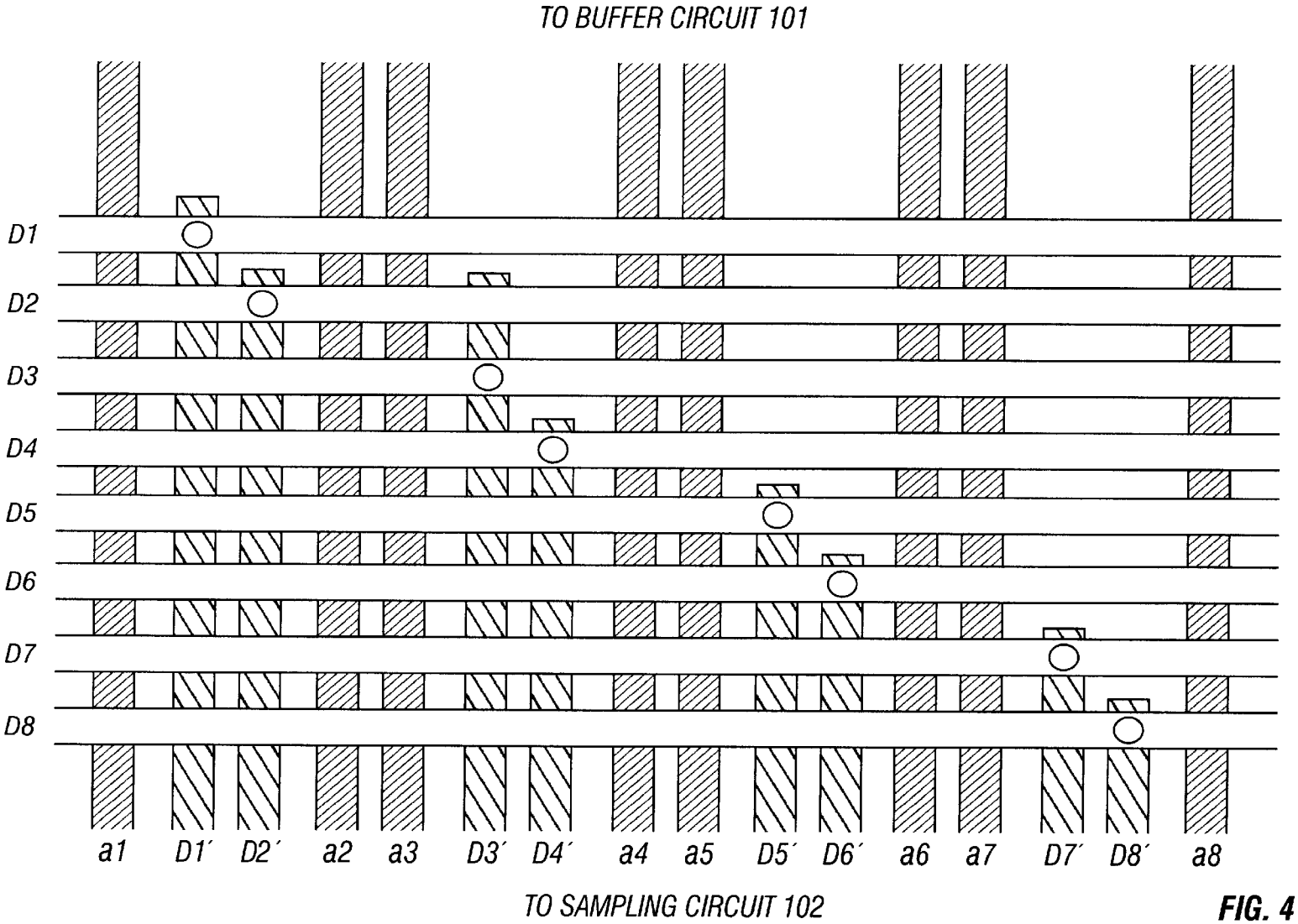
FIG. 4 (Prior Art)
FIG. 4 is a diagram illustrating the conductor pattern of the signal bus lines shown in FIG. 3.
Figure 5:
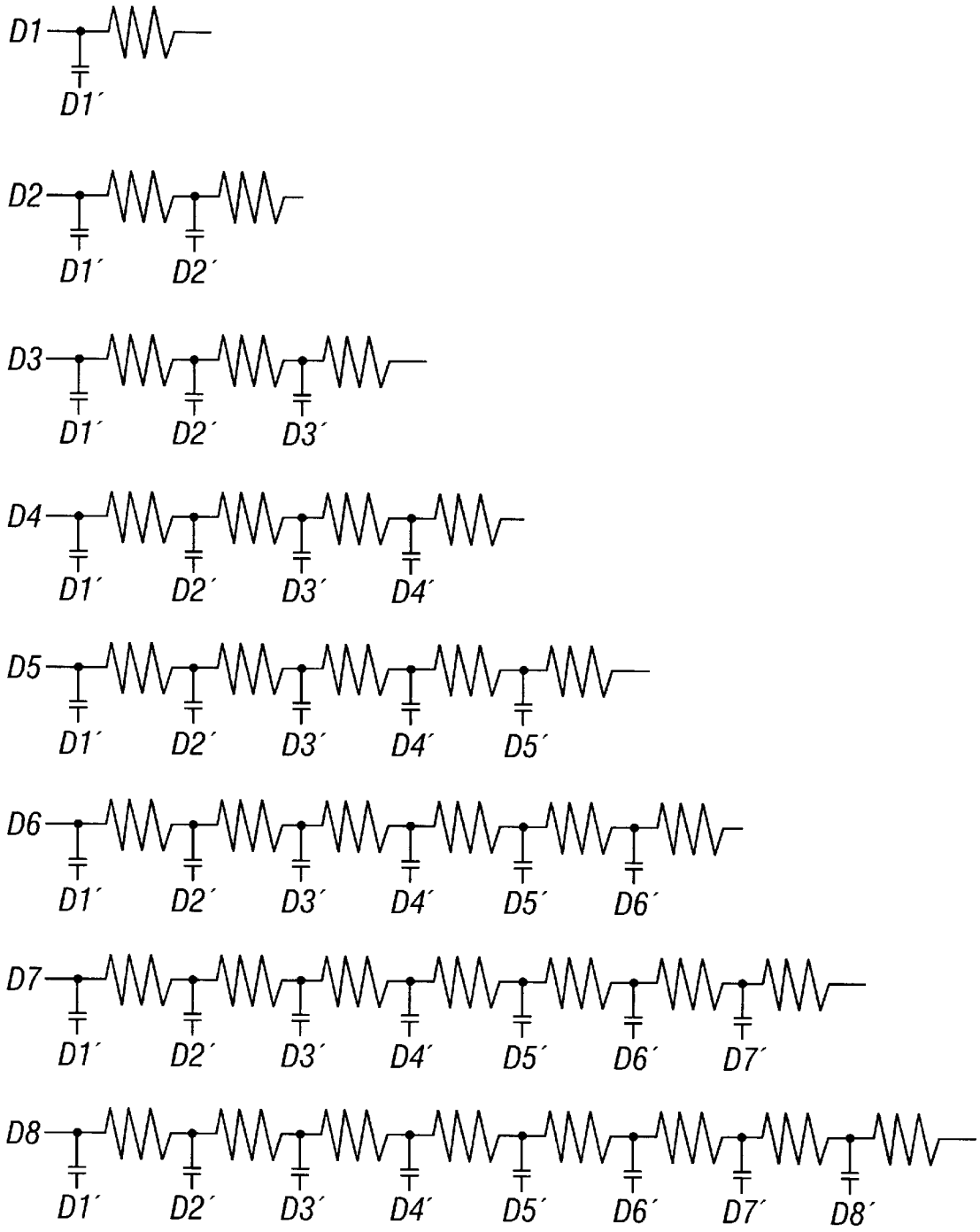
FIG. 5 is an equivalent circuit diagram of the resistances and parasitic capacitances of conducting lines for supplying image data signals within an active matrix liquid crystal display.

PATENT NO. : 5,956,009
DATED : September 21, 1999
INVENTOR(S) : Hongyong Zhang, Kenji Otsuka and Satoshi Teramoto It is certified that error appears in the above-identified patent and that said Letters Patent is hereby corrected as shown below:

Please substitute the attached FIG. 3 and FIG. 5

Signed and Sealed this

Fifth Day of March, 2002

*Attest:*

*Attesting Officer*

JAMES E. ROGAN
*Director of the United States Patent and Trademark Office*

TO ACTIVE MATRIX CIRCUIT 15

UNITED STATES PATENT AND TRADEMARK OFFICE

CERTIFICATE OF CORRECTION

PATENT NO. : 5,956,009 
DATED : September 21, 1999
INVENTOR(S) : Satoshi Teramoto, Kenji Otsuka and Hongyong Zhang It is certified that error appears in the above-identified patent and that said Letters Patent is hereby corrected as shown below:

Drawings,
Please substitute Fig. 7 with corrected Fig. 7 on the attached page.

Signed and Sealed this

Third Day of December, 2002

JAMES E. ROGAN
*Director of the United States Patent and Trademark Office*